US010101071B2

(12) United States Patent
Oh et al.

(10) Patent No.: US 10,101,071 B2
(45) Date of Patent: Oct. 16, 2018

(54) REFRIGERATOR WITH ICE MAKER

(75) Inventors: Seunghwan Oh, Seoul (KR); Moongyo Jung, Seoul (KR); Bongjin Kim, Seoul (KR); Seongjae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 163 days.

(21) Appl. No.: 13/703,050

(22) PCT Filed: Jun. 10, 2011

(86) PCT No.: PCT/KR2011/004291
§ 371 (c)(1),
(2), (4) Date: Feb. 28, 2013

(87) PCT Pub. No.: WO2011/155801
PCT Pub. Date: Dec. 15, 2011

(65) Prior Publication Data

US 2013/0152617 A1 Jun. 20, 2013

(30) Foreign Application Priority Data

Jun. 10, 2010 (KR) ..... 10-2010-0054860

(51) Int. Cl.

| | |
|---|---|
| ***F25C 1/12*** | (2006.01) |
| ***F25C 1/22*** | (2018.01) |
| ***F25C 1/24*** | (2018.01) |
| ***F25C 5/08*** | (2006.01) |

(52) U.S. Cl.
CPC ..... *F25C 1/24* (2013.01); *F25C 5/08* (2013.01); *F25C 2400/02* (2013.01)

(58) Field of Classification Search
CPC ..... F25C 1/24; F25C 5/08; F25C 2400/02; F25C 1/12; F25C 1/22; F25C 5/02
USPC ..... 62/351, 340, 344; 249/114.1, 105, 119, 249/203, 129
See application file for complete search history.

(56) References Cited

U.S. PATENT DOCUMENTS

| | | | | |
|---|---|---|---|---|
| 2,264,849 A | | 12/1941 | Kitto | |
| 6,112,540 A | * | 9/2000 | Serrels | F25C 1/04 62/351 |
| 7,185,508 B2 | | 3/2007 | Voglewede | |
| 7,444,829 B2 | * | 11/2008 | Mori | F25C 1/22 249/78 |

(Continued)

FOREIGN PATENT DOCUMENTS

| | | |
|---|---|---|
| CN | 1766469 A | 5/2006 |
| EP | 1 653 170 A2 | 5/2006 |

(Continued)

OTHER PUBLICATIONS

International Search Report dated Feb. 10, 2012 for Application No. PCT/KR2011/004291, 2 pages.

(Continued)

*Primary Examiner* — Frantz Jules
*Assistant Examiner* — Martha Tadesse
(74) *Attorney, Agent, or Firm* — Fish & Richardson P.C.

(57) ABSTRACT

Provided is a refrigerator with an ice maker. The ice maker includes an ice tray formed of a metal material, the ice tray providing an ice making space in which water for making an ice is supplied to make the ice and a resin layer formed of a plastic resin, the resin layer defining at least portion of the ice making space to smoothly convey the ice.

8 Claims, 13 Drawing Sheets

(56) References Cited

U.S. PATENT DOCUMENTS

| | | | | |
|---|---|---|---|---|
| 8,596,084 | B2 * | 12/2013 | Herrera | F25C 5/22 62/351 |
| 2005/0061018 | A1 * | 3/2005 | Kim et al. | 62/344 |
| 2006/0086134 | A1 * | 4/2006 | Voglewede | F25C 1/10 62/351 |
| 2006/0288726 | A1 | 12/2006 | Mori et al. | |
| 2007/0151282 | A1 * | 7/2007 | Jeong | F25C 1/04 62/349 |
| 2007/0170345 | A1 * | 7/2007 | Tsujimoto | F25C 1/243 249/114.1 |
| 2008/0295539 | A1 * | 12/2008 | An et al. | 62/407 |
| 2009/0020681 | A1 * | 1/2009 | Lee | F25C 1/22 249/110 |
| 2009/0308095 | A1 * | 12/2009 | An | F25C 5/08 62/351 |
| 2011/0023510 | A1 * | 2/2011 | Lee | F25C 1/04 62/137 |

FOREIGN PATENT DOCUMENTS

| | | | |
|---|---|---|---|
| EP | 1653178 | | 5/2006 |
| EP | 1 696 190 | A1 | 8/2006 |
| EP | 1798500 | | 6/2007 |
| JP | 2001-133094 | A | 5/2001 |
| JP | 2002-286337 | A | 10/2002 |
| JP | 2002-364960 | A | 12/2002 |
| JP | 2003-065641 | A | 3/2003 |
| JP | 2005-090814 | | 4/2005 |
| JP | 2005-180823 | A | 7/2005 |
| JP | 2007-057198 | A | 3/2007 |
| JP | 2008-304101 | | 12/2008 |
| KR | 10-0255951 | B1 | 5/2000 |
| KR | 10-2005-0022066 | | 3/2005 |
| WO | WO 2005/061974 | A1 | 7/2005 |

OTHER PUBLICATIONS

Chinese Office Action and Search Report dated Apr. 21, 2014 for CN Application No. 201180028580.X, with partial English Translation, 10 pages.

Extended European Search Report issued in European Application No. 11792712.9 dated Aug. 17, 2016, 8 pages.

* cited by examiner

[Fig. 1]
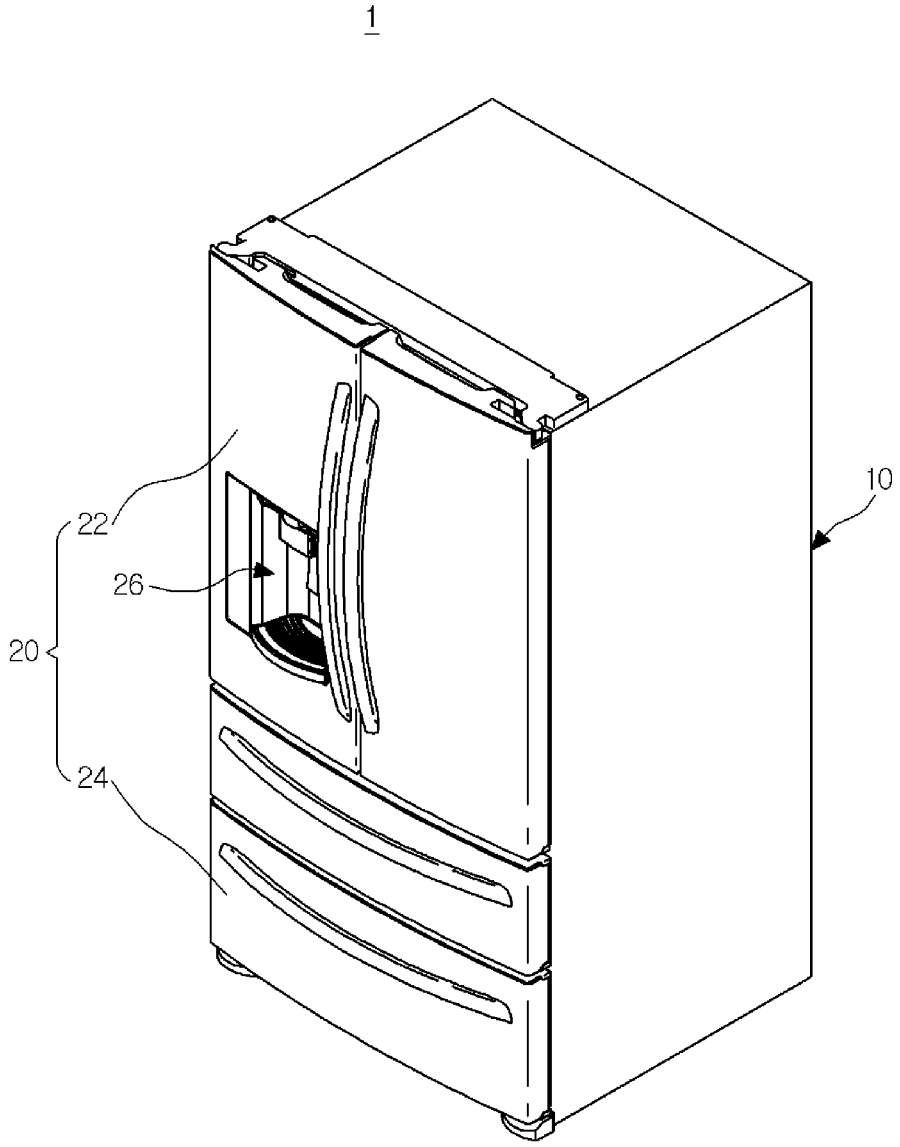

[Fig. 2]
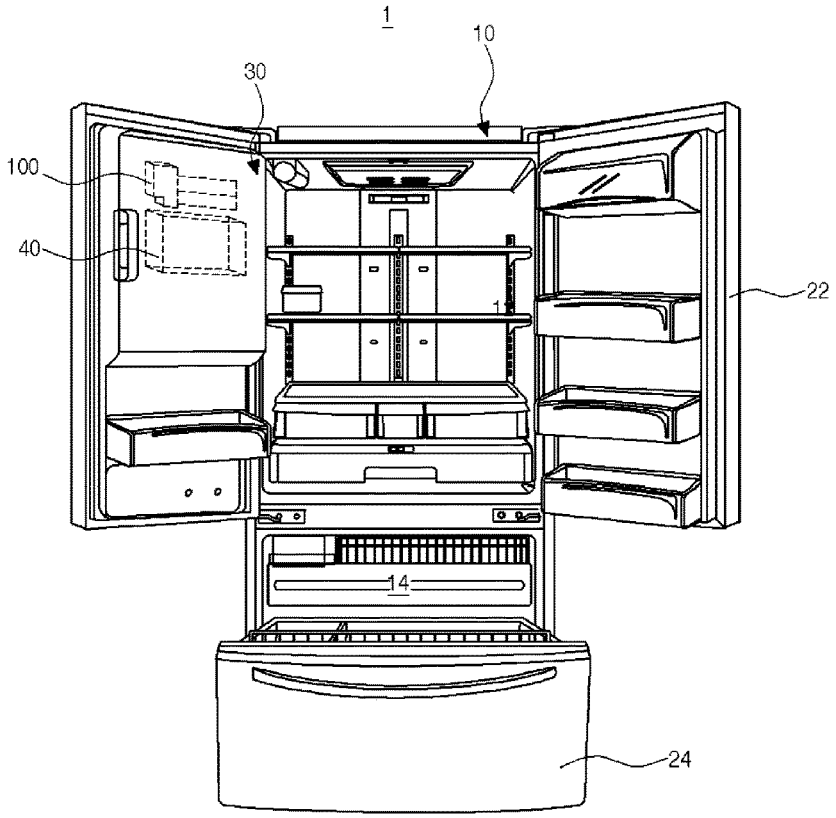
[Fig. 3]
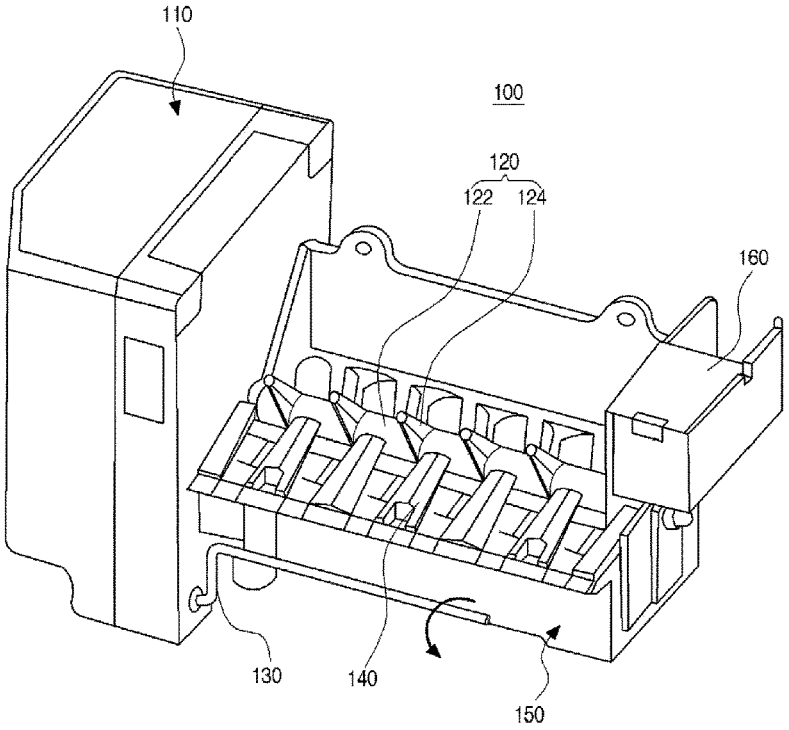

[Fig. 4]
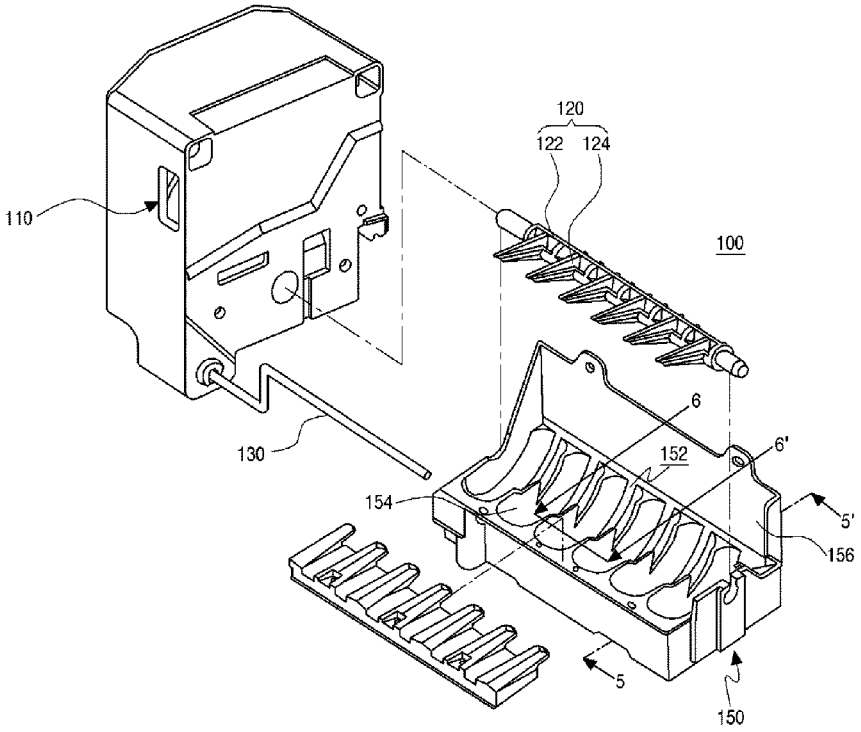
[Fig. 5]
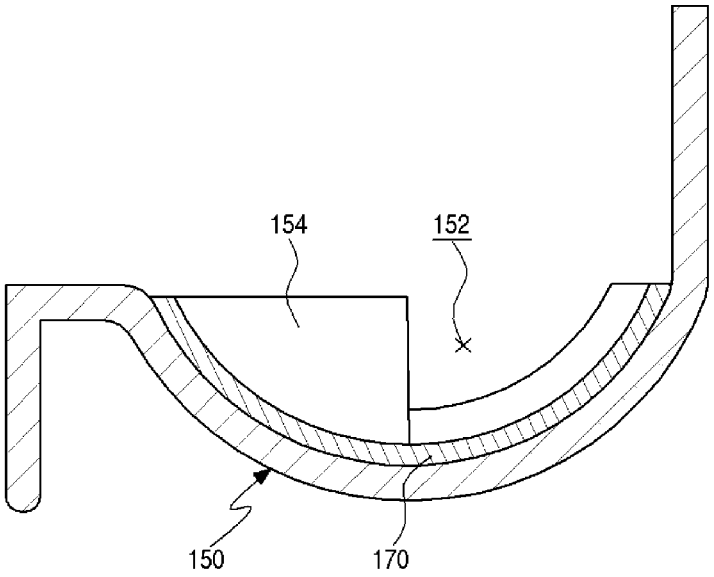

[Fig. 6]
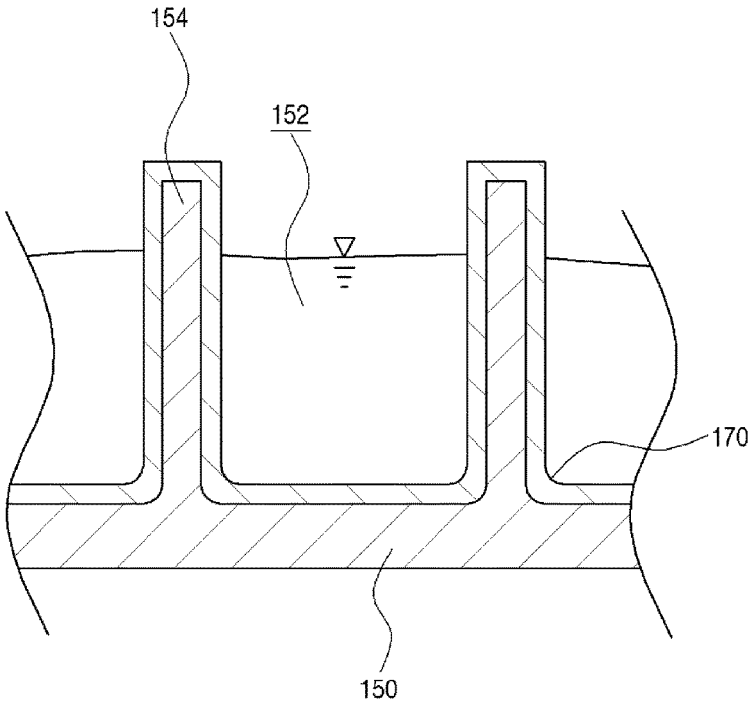
[Fig. 7]
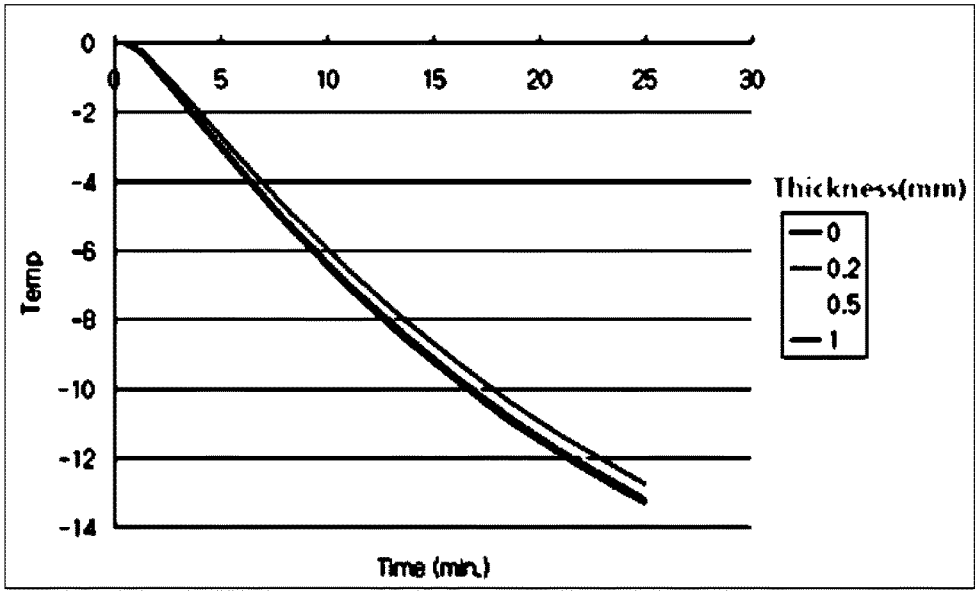

[Fig. 8]
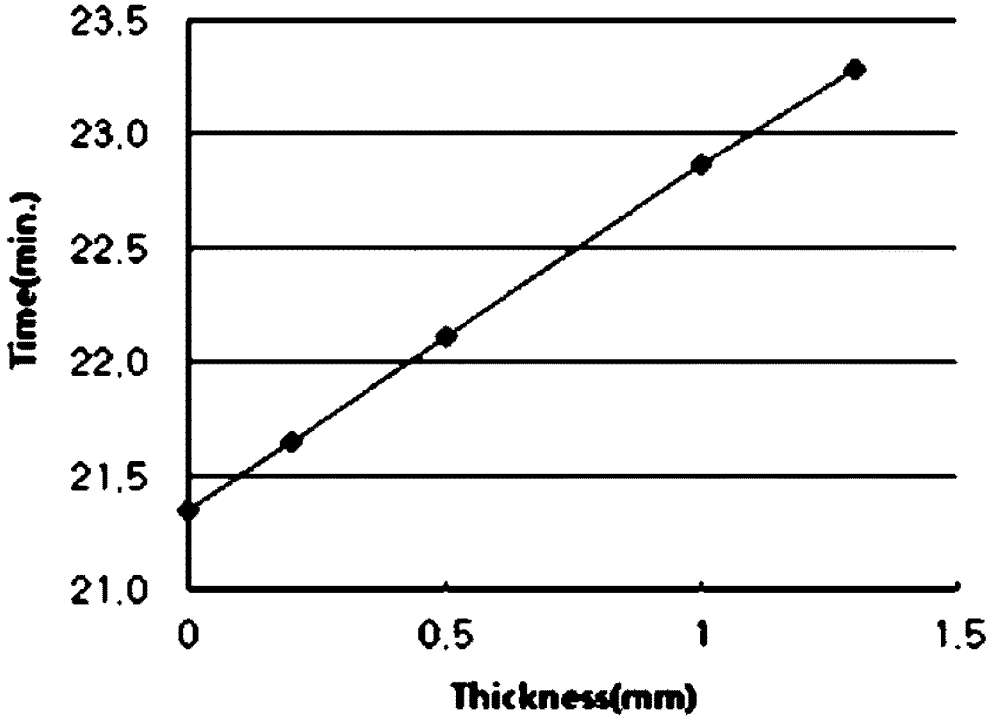
[Fig. 9]
Compare cooling rate differences according to coating thickness
| Thickness / Temperature | 0 | 0.2 | 0.5 | 1 | 1.3 |
|---|---|---|---|---|---|
| 0 | 0.3 | 0.3 | 0.3 | 0.4 | 0.4 |
| -3 | 5.0 | 5.1 | 5.3 | 5.6 | 5.7 |
| -6 | 9.2 | 9.4 | 9.6 | 10.0 | 10.2 |
| -9 | 14.4 | 14.6 | 15.0 | 15.6 | 15.9 |
| -12 | 21.3 | 21.6 | 22.1 | 22.9 | 23.3 |
| -15 | 30.2 | 30.5 | 31.0 | 31.6 | 32.0 |

[Fig. 10]
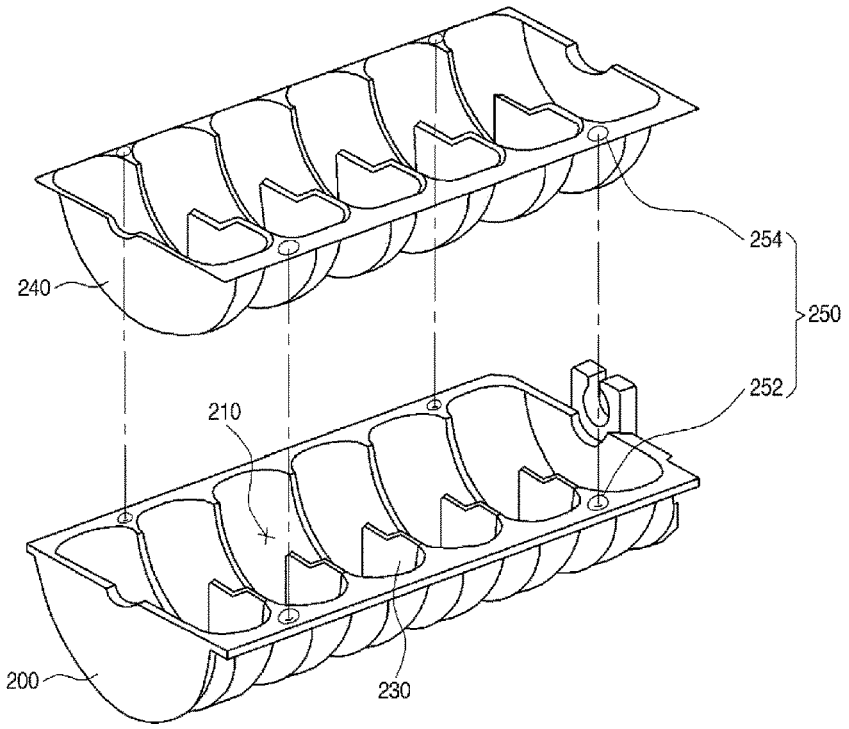
[Fig. 11]
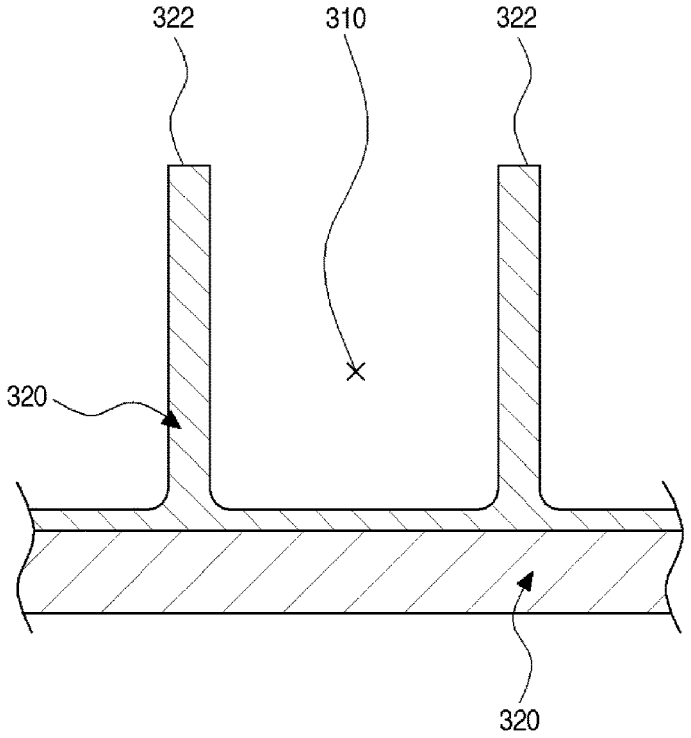

[Fig. 12]
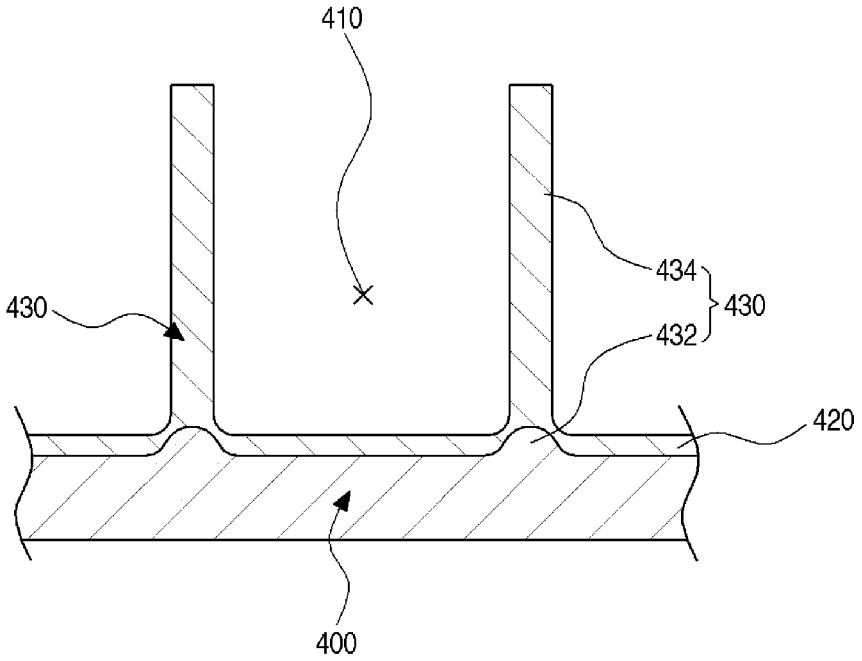
[Fig. 13]
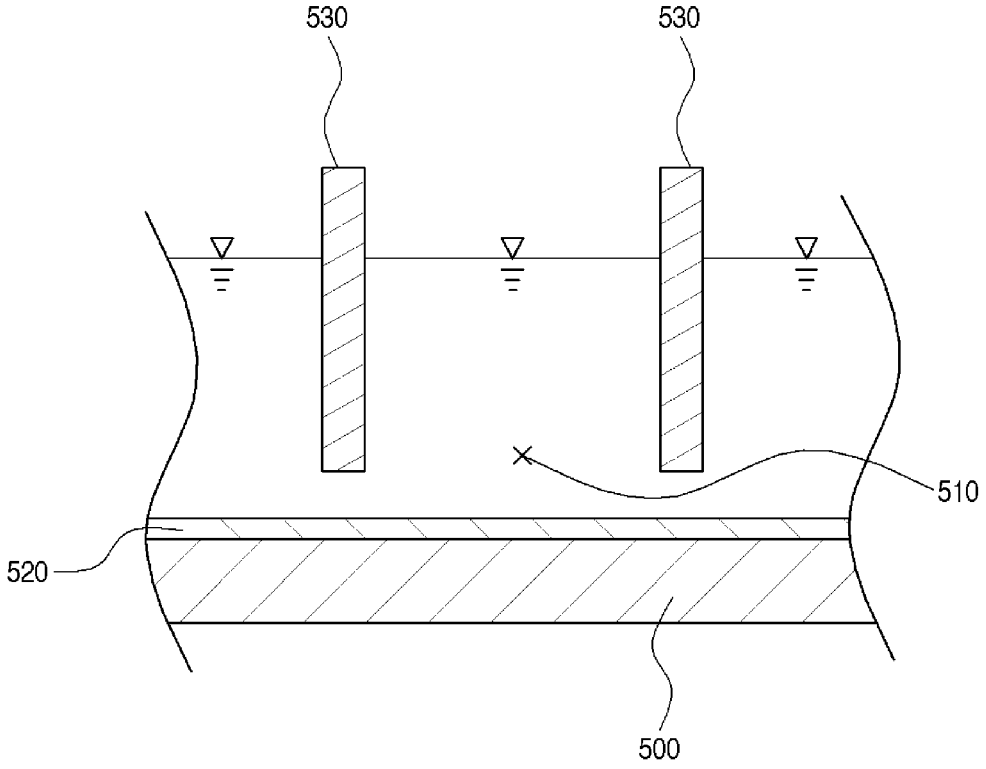

[Fig. 14]
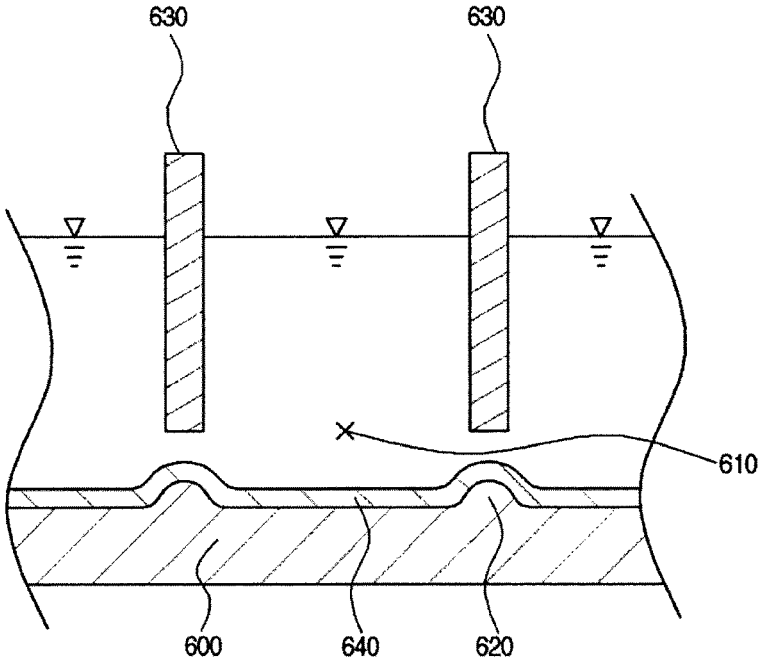
[Fig. 15]
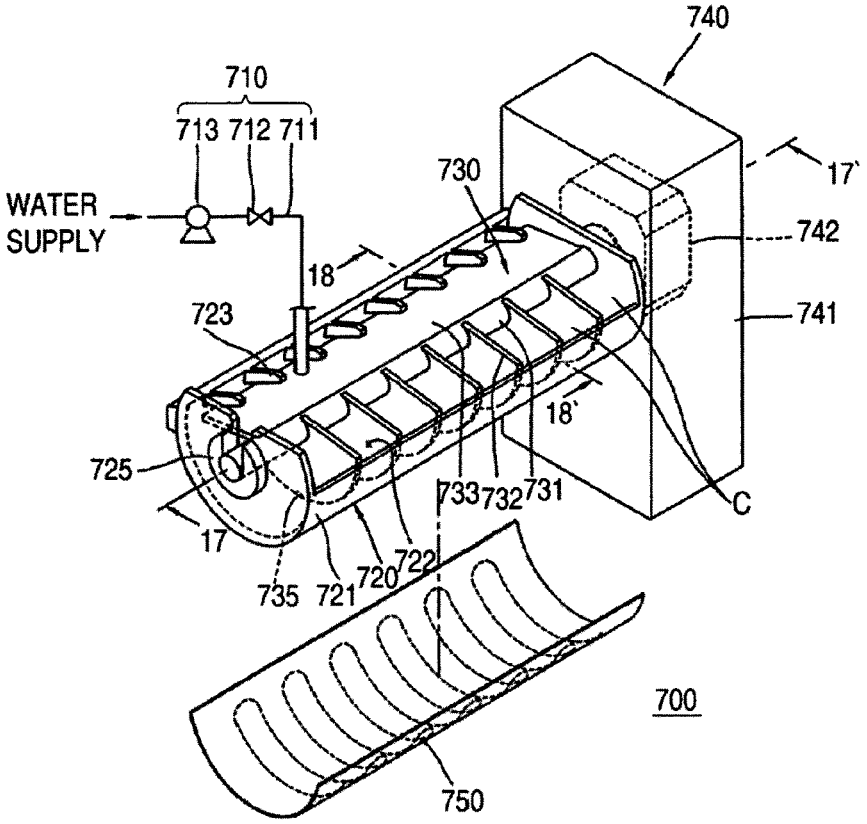

[Fig. 16]
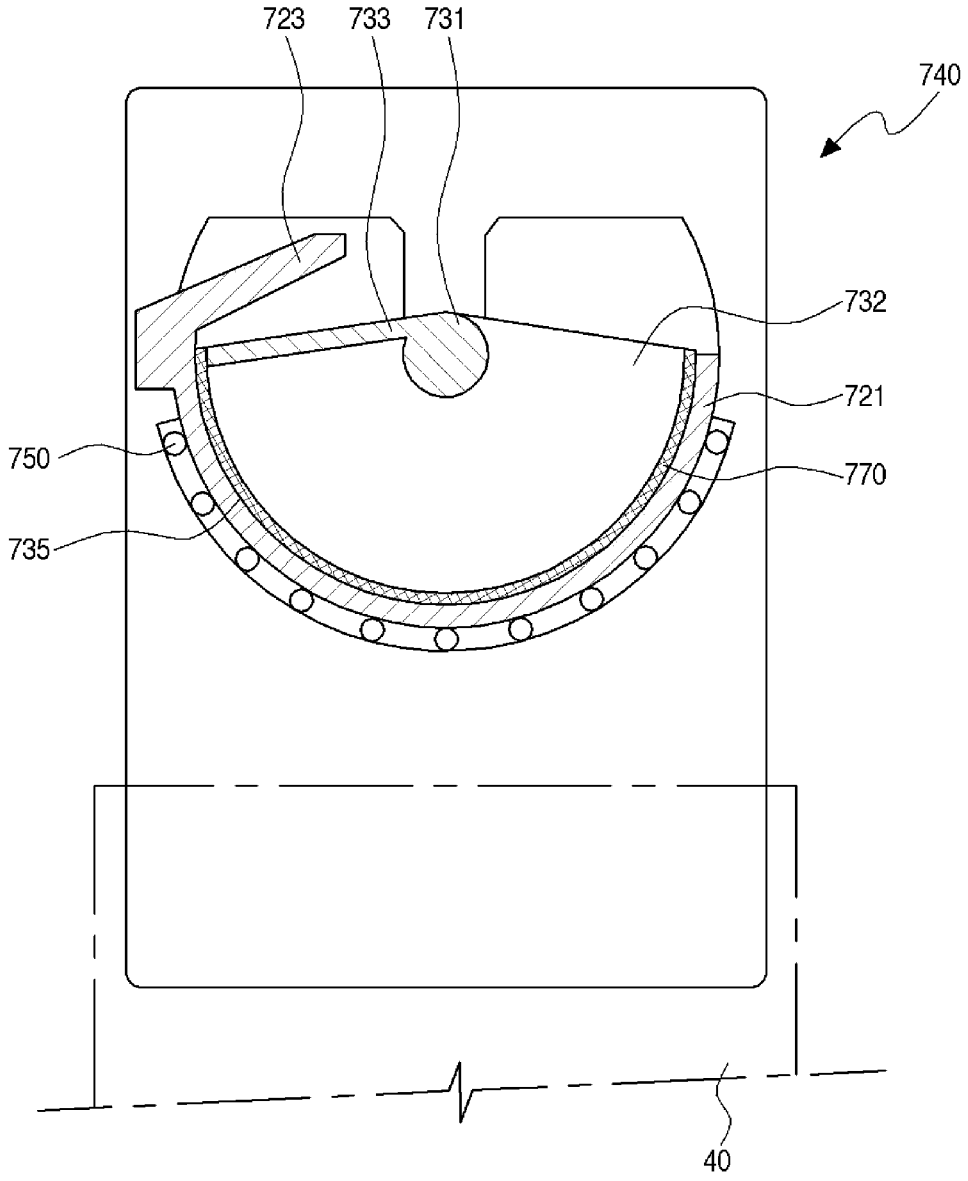

[Fig. 17]
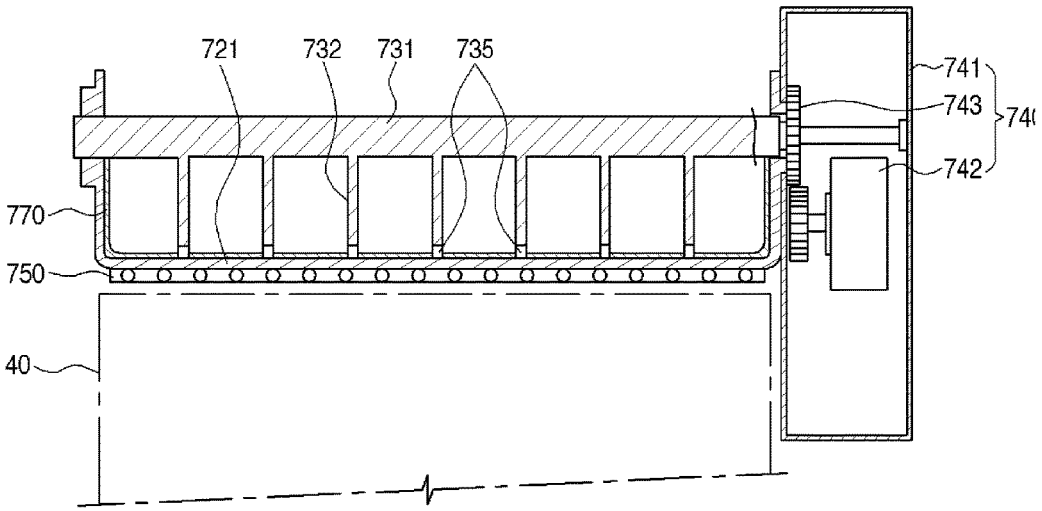
[Fig. 18]
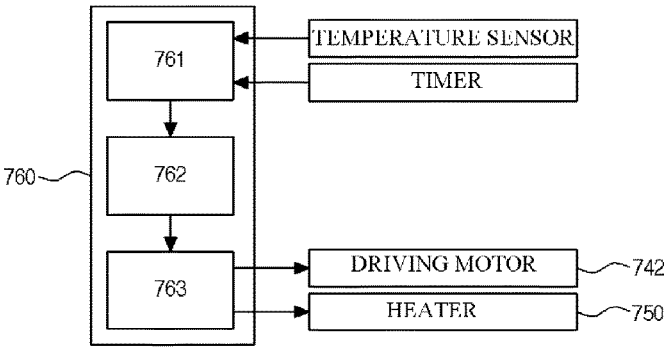

[Fig. 19]
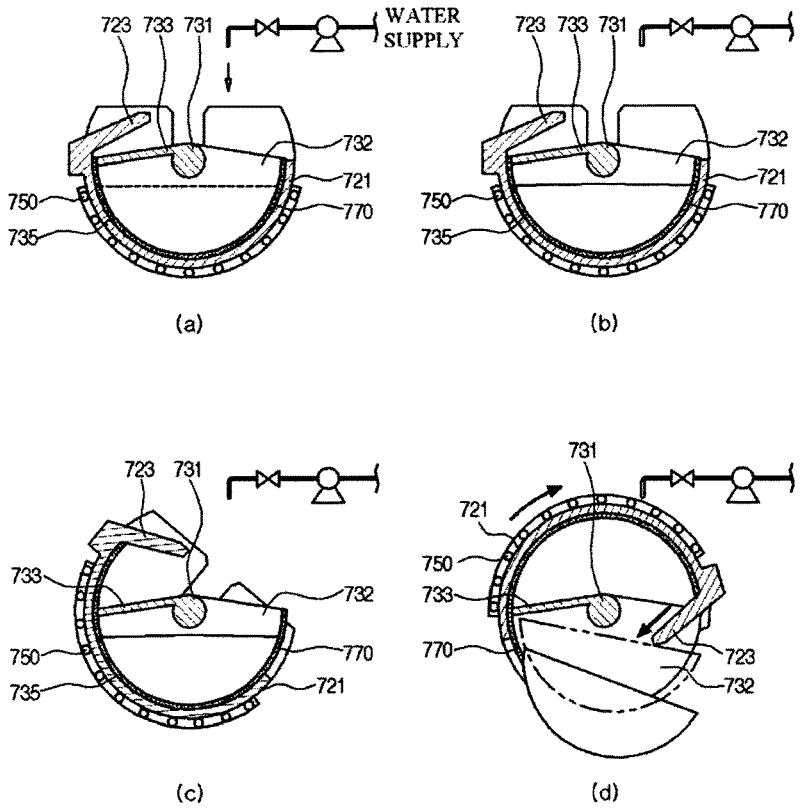
[Fig. 20]
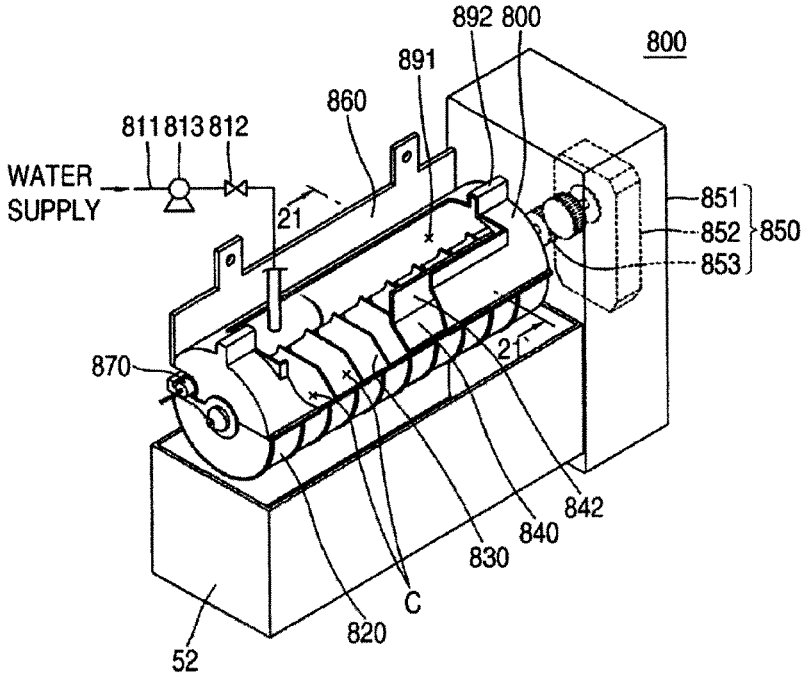

[Fig. 21]
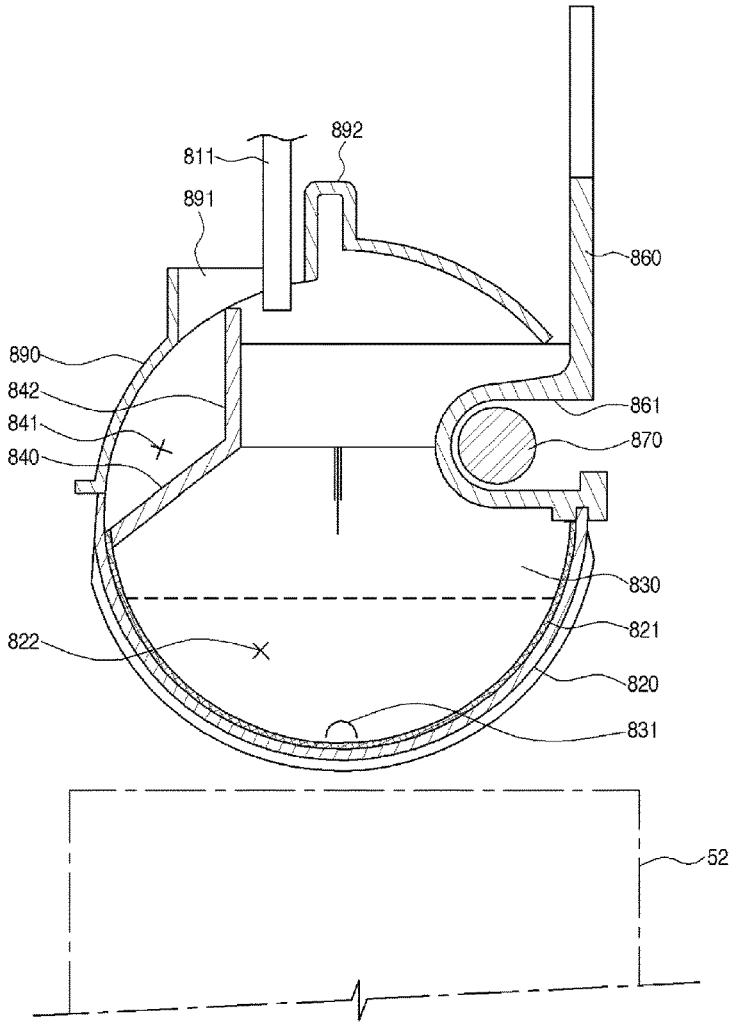
[Fig. 22]
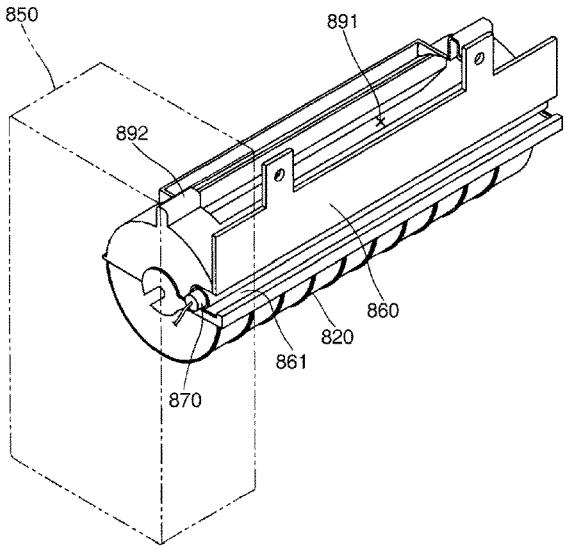

[Fig. 23]
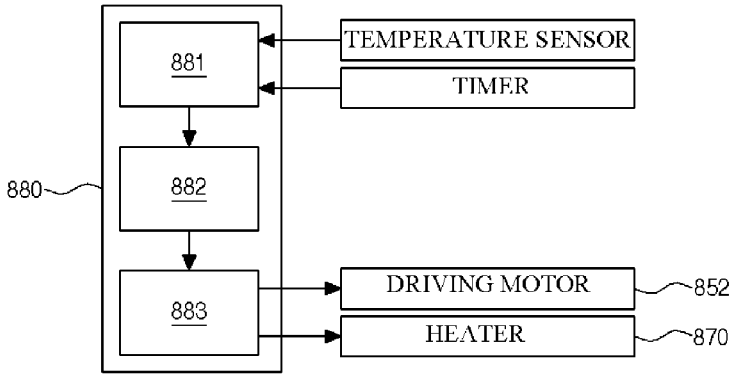
[Fig. 24]
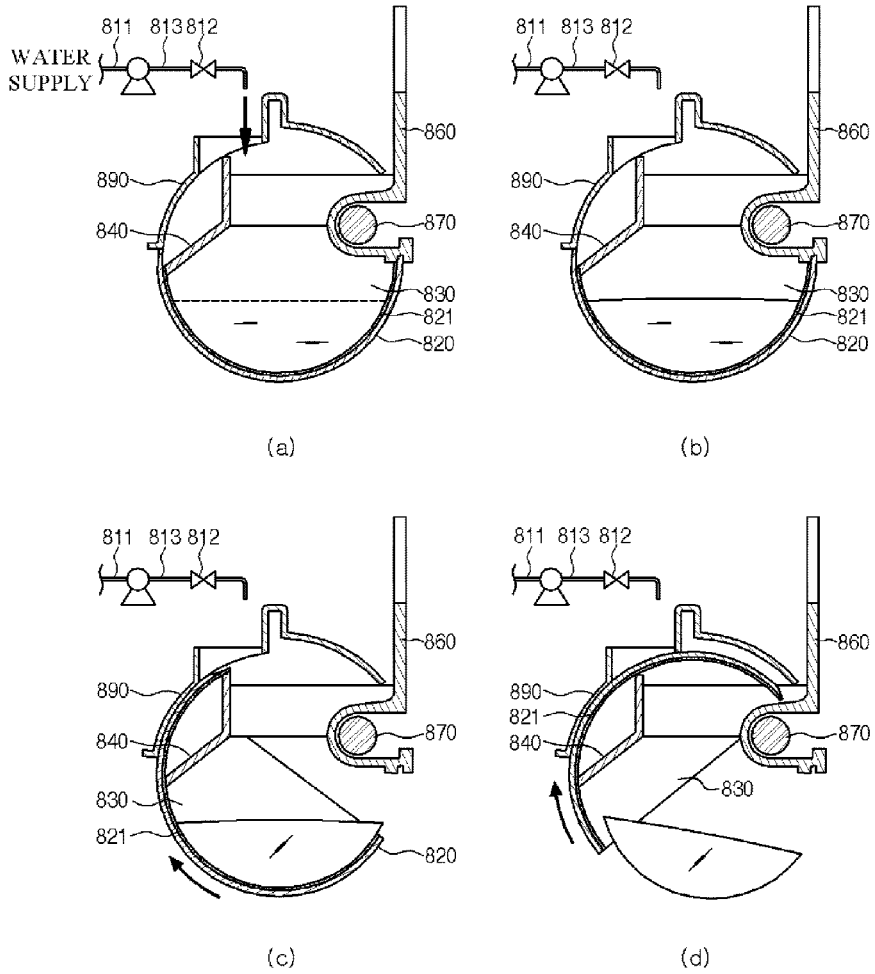

REFRIGERATOR WITH ICE MAKER

CROSS REFERENCE TO RELATED APPLICATIONS

This application is a U.S. National Phase Application under 35 U.S.C. § 371 of International Application PCT/KR2011/004291, filed on Jun. 10, 2011, which claims the benefit of Korean Application No. 10-2010-0054860, filed on Jun. 10, 2010, the entire content of the prior applications is hereby incorporated by reference.

TECHNICAL FIELD

Embodiments relate to a refrigerator with an ice maker.

BACKGROUND ART

In general, a refrigerator is a home appliance that can store foods at a low temperature in an internal storage space shield by a door. The refrigerator cools the inside of the storage space using cool air generated by heat-exchanging with a refrigerant that circulates a cooling cycle to store the foods in an optimum state.

An ice maker for making an ice is disposed inside the typical refrigerator. In the ice maker, water supplied from a water supply source or a water tank is received in the ice tray to make the ice. Also, the ice maker may convey the ice from the made ice tray using a heating method or a twisting method.

In case of the ice maker in which the made ice is conveyed using the heating method, the ice tray is formed of a metal material having superior heat transfer performance. Also, a heater is disposed on the ice tray. When the made ice is conveyed, the heater generates heat to melt a surface of the ice, thereby easily separating the ice from the ice tray.

In the ice maker having the above-described structure, since the ice tray is formed of the metal material having the superior heat transfer performance, a large amount of ices may be quickly made. On the other hand, since the heater generates heat during the conveying of the ice, a load may occur in the refrigerator to increase power consumption.

In case of the ice maker in which the made ice is conveyed using the twisting method, the ice tray is formed of a plastic material. When the made ice is conveyed, the ice may be separated from the ice maker due to the twisting of the ice tray.

In the ice maker having the above-described structure, since a separate load does not occur in the refrigerator, the power consumption may be relatively low. On the other hand, since thermal conductivity of the ice tray is low, an ice making amount may be relatively small.

DISCLOSURE OF INVENTION

Technical Problem

Embodiments provide a refrigerator with an ice maker in which a resin layer formed of a resin material is disposed on an ice tray formed of a metal material to improve ice making performance and reduce power consumption.

Solution to Problem

In one embodiment, a refrigerator includes: a cabinet defining a storage space; and an ice maker disposed in the storage space, the ice maker making an ice, wherein ice maker includes: an ice tray receiving water for making the ice, the ice tray being formed of a metal material and defining an ice making space in which the ice is made; and a resin layer formed of a resin, the resin layer defining at least portion of an inner surface within the ice making space of the ice tray to smoothly convey the ice.

A partition plate for partitioning the ice making space into a plurality of spaces may be disposed in the ice tray.

A portion of the ice tray may protrude to form the partition plate.

The partition plate may be disposed in the ice maker so that at least portion of the partition plate is spaced from the inner surface of the ice tray.

The partition plate may be formed by the resin layer protruding toward the inside of the storage space.

The partition plate may include: a protrusion part protruding at a side of the ice tray; and an extension part in which the resin layer extends from an end of the protrusion part.

The resin layer may be disposed on the inner surface of the ice tray and an outer surface of the partition plate.

The resin layer may surround the ice making space and a circumference surface of the ice making space.

The resin layer may be coated on the molded ice tray.

The resin layer and the ice tray may be manufactured through separate processes, and the resin layer may adhere or be fused to the ice tray.

The resin layer and the ice tray may be manufactured through separate processes, and the resin layer may be shapely coupled to the ice tray.

The resin layer may be manufactured on the molded ice tray using an insertion injection process.

The ice maker may further include a driving unit coupled to the ice tray to rotate the ice tray.

The ice maker may include: an ejector rotated to convey the ice within the ice making space; and a driving unit coupled to the ejector, the driving unit rotating the ejector.

The ice maker may further include a heater for heating a surface of the ice made in the ice tray.

The details of one or more embodiments are set forth in the accompanying drawings and the description below. Other features will be apparent from the description and drawings, and from the claims.

Advantageous Effects of Invention

According to the proposed embodiments, the ice tray may be formed of the metal material having the superior heat transfer performance to quickly freeze the water received in the ice tray, thereby making ices.

Also, the resin layer disposed on the ice tray may have very superior water-repellency when compared to that of a metal. Thus, the ice may be easily separated from the ice tray without heating the made ice when the ice is conveyed.

Thus, since the ice making amount is secured for a relatively short time due to the quick ice making operation, the ice making performance may be improved. Also, since the heater is not used when the ice is conveyed, an occurrence of the load within the refrigerator may be minimized to reduce the power consumption.

Also, since the heater used for conveying the ice from the ice tray is omitted, the remaining water generated when the ice is conveyed may not be generated. Thus, it may prevent the ices stored under the ice tray from getting tangled with each other. In addition, quality of the made ice may be improved.

The heater for heating the ice made in the ice maker including the resin layer may be further disposed on the ice tray. Here, since the resin layer assists the conveying of the ice, the heating time of the heater may be minimized. Therefore, the ice may be effectively conveyed and the power consumption may be reduced.

BRIEF DESCRIPTION OF DRAWINGS

FIG. 1 is a perspective view of a refrigerator according to an embodiment.

FIG. 2 is a view illustrating a state in which a door of the refrigerator is opened.

FIG. 3 is a perspective view of an ice maker according to an embodiment.

FIG. 4 is an exploded perspective view of the ice maker.

FIG. 5 is a sectional view taken along line 5-5' of FIG. 4.

FIG. 6 is a sectional view taken along line 6-6' of FIG. 4.

FIG. 7 is a graph illustrating a variation of a temperature per unit time according to on a thickness of a resin layer when an ice making process is performed in the refrigerator according to an embodiment.

FIG. 8 is a graph illustrating a time to reach about 12 degrees below zero according to the thickness of the resin layer when the ice making process is performed in the refrigerator according to an embodiment.

FIG. 9 is a graph of a set temperature reaching time according to the thickness of the resin layer when the ice making process is performed in the refrigerator according to an embodiment.

FIG. 10 is an exploded perspective view of an ice tray according to an embodiment.

FIG. 11 is a sectional view of an ice tray according to another embodiment.

FIG. 12 is a sectional view of an ice tray according to another embodiment.

FIG. 13 is a sectional view of an ice tray according to another embodiment.

FIG. 14 is a sectional view of an ice tray according to another embodiment.

FIG. 15 is a perspective view of an ice maker according to another embodiment.

FIG. 16 is a sectional view of the ice maker.

FIG. 17 is a longitudinal sectional view of the ice maker.

FIG. 18 is a schematic view of a control unit according to another embodiment.

FIG. 19 is a longitudinal sectional view illustrating an ice making process of the ice maker.

FIG. 20 is a perspective view illustrating an ice maker of FIG. 1 according to another embodiment.

FIG. 21 is a sectional view taken along line 21-21' of FIG. 20.

FIG. 22 is a perspective view of a back surface of the ice maker.

FIG. 23 is a schematic view of a control unit according to another embodiment.

FIG. 24 is a longitudinal sectional view illustrating an ice making process of the ice maker.

MODE FOR THE INVENTION

Hereinafter, embodiments will be described in detail with reference to the accompanying drawings.

FIG. 1 is a perspective view of a refrigerator according to an embodiment. FIG. 2 is a view illustrating a state in which a door of the refrigerator is opened.

Referring to FIGS. 1 and 2, a refrigerator 1 according to an embodiment includes a cabinet 10 defining a storage space therein and a door 20 opening and closing the storage space. An outer appearance of the refrigerator 1 is defined by the cabinet 10 and the door 20.

In detail, the cabinet 10 has the vertically partitioned storage space. Here, a refrigerating compartment 12 is defined in an upper portion of the storage space, and a freezing compartment 14 is defined in a lower portion of the storage space. Receiving members such as drawers, shelves, and baskets may be disposed inside the refrigerating compartment 12 and the freezing compartment 14.

The door includes a refrigerating compartment door 22 shielding the refrigerating compartment 12 and a freezing compartment door 24 shielding the freezing compartment 14. The refrigerating compartment door 22 includes a pair of left and right doors. The refrigerating compartment door 22 may be rotatably opened or closed. The freezing compartment door 24 may be withdrawn in a drawer-type.

The disposition and of the refrigerating compartment 12 and the freezing compartment 14 and a shape of the door 20 may be changed according to a kind of refrigerator. However, the present disclosure is not limited thereto. For example, the current embodiment may be applied to various kinds of refrigerators.

An ice making chamber 30 for making ices is defined in the refrigerating compartment door 22. The ice making chamber 30 is defined as an insulated independent space in the refrigerating compartment door 22. Also, the ice making chamber is defined as a space in which ices are made by cool air supplied from an evaporator and stored therein.

An ice maker 100 for making ices is disposed inside the ice making chamber 30. Water may be automatically supplied into the ice maker 100 from the refrigerator or a water supply source of the refrigerator. Also, when an ice making operation is completed, the made ices may be automatically conveyed. An ice bank 40 in which the made ices are conveyed from the ice maker 100 and stored therein may be disposed under the ice maker 100.

A dispenser 26 for dispensing the made ices to the outside may be disposed on a front surface of the refrigerating compartment door 22 including the ice making chamber 30. The dispenser 26 may communicate with the ice making chamber 30. Also the dispenser 26 may be configured to dispense purified water.

The ice making chamber 30 may be defined within the refrigerating compartment. In this case, the ice making chamber may communicate with the dispenser 26 in a state where the refrigerator compartment door 22 is closed.

The ice maker 100 may be disposed within the ice making chamber 30 as well as the freezing compartment door 24 or the refrigerating compartment 14. Alternatively, the ice maker 100 may be disposed in various positions at which ices can be made such as the inside of the refrigerator or an inner surface of the refrigerator.

Also, the ice maker 100 may be variously manufactured according to a water supply method and an ice conveying method. The ice maker 100 may be disposed on the refrigerating compartment, the freezing compartment, or the door. However, the present disclosure is limited thereto. For example, the embodiment may be applied to various ice makers including an ice tray in which water for making ices is received to make ices.

Hereinafter, an ice maker in which water is automatically supplied and ices are automatically conveyed will be described as an example.

FIG. 3 is a perspective view of an ice maker according to an embodiment. FIG. 4 is an exploded perspective view of the ice maker.

Referring to FIGS. 3 and 4, the ice maker 100 may include a driving unit 110, an ice tray 150, and an ejector 120.

In detail, the driving unit 110 is disposed at a side of the ice maker 100. The driving unit 110 includes an electric motor and a plurality of gears to rotate the ejector 120.

The ejector 120 is connected to a side of the driving unit 110. The ejector 120 separates the ices made on the ice tray from the ice try. The ejector 120 includes an ejector shaft 122 rotatably connected to a side of the driving unit 110 and an ejector pin 124 extending from the ejector shaft 122 to draw ices upward.

An ice-full state detection unit 130 may be disposed on the other side of the driving unit 110. The ice-full state detection unit 130 may be rotated by the driving unit 110 to detect an ice-full state of the ices stored in the ice bank 40.

A stripper 140 may be further disposed on a top surface of the ice tray 150. The stripper 140 may cover a portion of the opened top surface of the ice tray 150. Also, a portion of the stripper 140 may be cut to allow the ejector 120 to pass. The stripper 140 may be formed of an elastically deformable material.

The stripper 140 prevents water received in the ice tray 150 from overflowing. Also, when the ices are conveyed by the ejector 120, the stripper 140 may guide the conveyed ices to move the ices into a front side of the ice tray 150.

The ice tray 150 is disposed at a side of the driving unit 110. The ice tray 150 defines an ice making space in which water for making ices is supplied and ices are made. The ice tray 150 may be formed of a metal material having superior heat transfer performance such as aluminum or an aluminum alloy.

The ice making space 152 of the ice tray 150 may be partitioned into a plurality of spaces by a plurality of partition plates 154. The partition plates 154 protrude from an inner surface of the ice tray 150 to extend up to a predetermined length. Also, the partition plates 154 may be disposed so that at least portion thereof is disposed at a relatively low position to uniformly supply the supplied water into the partitioned spaces thereof.

A fixing part 156 may be disposed at a side of the ice try 150 to fix the ice tray 150 or the ice maker 100 to the inside of the ice making chamber 30.

A water supply part 160 for supplying the automatically supplied water into the ice tray 150 may be further disposed under the ice tray 150. Also, although not shown, a temperature sensor and for detecting a temperature of the ice tray 150 and a temperature sensor for detecting a temperature of the inside of the ice making chamber 30 may be further provided. As necessary, a heater (not shown) for heating the ice tray 150 when the ices are conveyed may be further disposed under the ice tray 150.

FIG. 5 is a sectional view taken along line 5-5' of FIG. 4. FIG. 6 is a sectional view taken along line 6-6' of FIG. 4.

Referring to FIGS. 5 and 6, a resin layer is disposed on the ice tray 150. The resin layer 170 defines at least portion of the ice making space of the ice tray 150. The resin layer may be formed of a plastic resin material.

In detail, the resin layer 170 may smoothly separate the made ices from the ice tray 150. The resin layer 170 may be formed of a water-repellent fluorocarbon resin, silicon, or polypropylene (PP).

The resin layer 170 may have a thickness changed according to materials. For example, when the resin layer 170 is formed of a Teflon material, the resin layer 170 may have a thickness of about 1 mm. Here, the thickness of the resin layer 170 may be adequately adjusted according to various conditions such as materials of the resin layers 170, a set time for making ices, and a temperature.

The resin layer 170 defines the ice making space 152 of the ice tray 150. The resin layer 170 may contact water received in the ice making space 152. Thus, the water-repellent resin layer 170 may smoothly separate the ices from the ice tray 150 when an external force is applied in a state where the ices are made in the ice making space 152.

The resin layer 170 may be disposed on an inner surface of the ice tray 150. The resin layer 170 may be disposed in the whole ice making space 152 of a portion of the ice making space 152. The resin layer 170 may be disposed on an outer surface of each of the partition plates 154.

The resin layer 170 may be closely attached to the inner surface of the ice tray 150. For this, the resin layer 170 may be coated on the previously formed ice tray 150.

In detail, a plastic resin material may be coated on the inner surface of the ice tray 150 previously formed of a metal material through a spraying, painting, or dipping method to form the resin layer 170.

The resin layer 170 is closely attached to the inside of the ice tray 150 to define at least portion of the ice making space 152. Also, the resin layer 170 may be smoothly heat-exchanged with the water within the ice making space 152. As necessary, the resin layer 170 may be formed together with the ice tray 150 through an insertion injection method.

The resin layer 170 may be disposed on the whole ice making space 152 in which the water is received. Also, the resin layer 170 may surround the whole partition plate 154. Alternatively, the resin layer 170 may be disposed on a portion of a region of the ice tray 150 one-to-one corresponding to a portion of the ice making space 152 or a portion of the partition plate 154.

An operation of the refrigerator including the above-described parts will be described below.

Cool air generated when the refrigerator 1 is operated may be supplied into the ice making chamber 30 to cool the inside of the ice making chamber 30. Also, water for making ices may be supplied into the ice tray 150.

When an adequate amount of water is supplied into the ice making space 152 defined in the ice tray 150, a preparing process for making an ice is completed. In this state, when the cool air is continuously supplied, the water received into the ice tray 150 may be gradually converted into an ice.

Here, when it is determined that a temperature of the ice tray 150 reaches a temperature at which the ice making process is completed, the ejector 120 is rotated by the operation of the driving unit 110. Then, the ejector 120 is rotated to allow the ejector pin 124 to draw the ice within the ice making space 152 upward.

Here, the ice made in the ice tray 150 may contact the resin layer 170. Since the ice contacting the resin layer 170 is disposed on a smooth surface of the water-repellent resin layer 170, the ice may be smoothly separated from the ice making space 152 by a force applied to the ejector 120.

The ice stored in the ice bank 40 may be maintained in a state stored within the ice bank 40 before the dispenser 26 is operated. Then, the processes of supplying water and conveying ices into the ice tray 150 are repeatedly performed until an ice-full state is detected by the operation of the ice-full state detection sensor 130.

FIG. 7 is a graph illustrating a variation of a temperature per unit time according to on a thickness of a resin layer when an ice making process is performed in the refrigerator according to an embodiment. FIG. 8 is a graph illustrating a time to reach about 12 degrees below zero according to the thickness of the resin layer when the ice making process is performed in the refrigerator according to an embodiment. FIG. 9 is a graph of a set temperature reaching time according to the thickness of the resin layer when the ice making process is performed in the refrigerator according to an embodiment.

Referring to FIGS. 7 to 9, a time at which the ice tray 150 or water or ice received in the ice tray 150 reaches a set temperature may be varied according to a thickness of the resin layer 170. In general, a set temperature for determining whether the ice making process is completed will be described below based on the received water having a temperature of about 12 degrees below zero.

When the resin layer 170 has a thickness of about zero, i.e., when the resin layer 170 is not disposed on the ice tray 150, it is seen that it take 21.3 minutes to reach a temperature of about 12 degrees below zero. Also, the more a thickness of the resin layer 170 becomes thicker, the more a time to reach about 12 degrees below zero becomes longer. For example, when the resin layer 170 has a thickness of about 1.3 mm, it is seen that it take 23.3 minutes to reach a temperature of about 12 degrees below zero.

When the more a thickness of the resin layer 170 becomes thicker, it is difficult to heat-exchange the ice tray 150 with the water received for making ices. Thus, it takes a long time to make ices.

When the resin layer 170 has a very thin thickness, it may be difficult to form the resin layer 170. In addition, durability of the resin layer 170 may be reduced. Also, when the resin layer 170 has a very thin thickness, it may be difficult to separate the ices from the ice tray 150. Accordingly, the thickness of the resin layer 170 should be set in consideration of following information.

When the resin layer 170 has a thickness of about 1 mm, it takes about 22.9 minutes to reach a temperature of about 12 degrees below zero. Thus, the formability and durability of the resin layer 170 may be secured simultaneously. Also, the ice making process may be completed within a time of about 23 minutes.

Although the resin layer 170 formed of the fluorocarbon resin is explained as an example, the present disclosure is not limited thereto. For example, the resin layer 170 may be formed of another plastic resin material.

Various embodiments except the foregoing embodiment may be applied. Hereinafter, another embodiment will be described.

Another embodiment is different from the foregoing embodiment in that a resin layer and an ice tray are manufactured through separate processes and coupled to each other. Thus, the parts except the ice tray and the resin layer are equal to those of the foregoing embodiment. Thus, the same part will be designated by the same reference numeral. Also, their detailed descriptions will be omitted.

FIG. 10 is an exploded perspective view of an ice tray according to an embodiment.

Referring to FIG. 10, an ice tray 200 according to another embodiment is formed of a metal material. The ice tray 200 may be formed of aluminum having superior heat conductivity or an aluminum alloy. An ice making space 210 in which water for making ices is received is defined inside the ice tray 200. The ice making space 210 may be partitioned by a partition plate 230.

A resin layer 240 is coupled to the ice tray 200. The resin layer 240 is formed of a plastic resin material. The resin layer 240 and the ice try 200 may be manufactured through separate processes using material different from each other through separate injection molding processes.

The resin layer 240 may have a shape corresponding to that of the inside of the ice tray 200. The resin layer 240 may have a shape corresponding to at least portion of the ice making space 210 defined in the ice tray 200. Thus, when water is filled in the ice making space 210, the resin layer 240 contacts the water or made ice.

The resin layer 240 may be closely attached to an inner surface of the ice tray 200. Also, the resin layer 240 may be coupled to the ice tray 200 through thermal fusion. Alternatively, an adhesive such as a primer may be coated on the resin layer 240 and the ice tray 200 to couple the ice tray 200 and the resin layer 240 to each other.

Also, coupling parts 250 having shapes corresponding to each other and shapely coupled to each other may be disposed on sides of the resin layer 240 and the ice tray 200, respectively. The coupling parts 250 may include a tray coupling part 252 having an uneven shape and a resin layer coupling part 254. When the resin layer 240 is coupled to the ice tray 200, the tray coupling part 252 and the resin layer coupling part 254 are shapely coupled to each other to more firmly couple the resin layer 240 to the ice tray 200.

The coupling parts 250 may use the shape of the ice tray 200. In detail, the resin layer 240 may be formed in a shape corresponding to that of the ice tray 200 to surround the whole upper portion of the ice tray 200. Then, the resin layer 240 is shapely coupled to the ice tray 200 through a forcedly fitting method to fixedly couple the resin layer 240 to the ice tray 200.

The resin layer 240 may be fixedly coupled to the ice tray 200 through the coupling parts 250. In addition, an adhesive may be coated between the ice tray 200 and the resin layer 240 or a thermal fusion process may be performed to couple the ice tray 200 to the resin layer 240.

Various embodiments except the foregoing embodiments may be applied. Hereinafter, another embodiment will be described.

Another embodiment is different from the foregoing embodiments in that a resin layer is disposed in an ice tray and at least portion of a partition plate is defined by a resin layer. Thus, the parts except the ice tray and the resin layer are equal to those of the foregoing embodiments. Thus, the same part will be designated by the same reference numeral. Also, their detailed descriptions will be omitted.

FIG. 11 is a sectional view of an ice tray according to another embodiment.

Referring to FIG. 11, an ice tray 300 may be formed of a metal material. An ice making space 310 in which water is received to make ices is defined in the ice tray 300. The ice making space 310 defined in the ice tray 300 may be formed as one space.

A resin layer 320 formed of a plastic resin material is disposed inside the ice tray 300. The resin layer 320 may be formed through various processes such as the above-described processes of the foregoing embodiments. Also, the resin layer 320 may define at least portion of the ice making space 310. Thus, an ice within the ice tray 300 contacting the resin layer 320 may be smoothly conveyed.

A portion of the resin layer 320 may extend inside the ice making space 310 to form a partition plate 322. The partition plate 322 may protrude inward from the ice tray 300 to partition the ice making space 310.

That is, the inside of the ice tray 300 may be defined as one space, and the resin layer 320 including the partition plate 322 may be disposed on an inner surface of the ice tray 300 to define ice making spaces 310 partitioned into a plurality of spaces.

FIG. 12 is a sectional view of an ice tray according to another embodiment.

Referring to FIG. 12, an ice tray 400 is formed of a metal material. Also, the ice tray 400 defines an ice making space 410 in which water is received to make ices. The ice making space 410 defined in the ice tray 400 may be formed as one space.

A plurality of protrusions 432 may be disposed on an inner surface within the ice making space 410. The protrusions 432 may define a portion of a partition 430 for partitioning the inside of the ice tray 400. Each of the protrusions 432 may have a shape protruding somewhat inward from the ice tray 400.

A resin layer 420 formed of a plastic resin material is disposed inside the ice tray 400. The resin layer 420 may be formed through various processes such as the above-described processes of the foregoing embodiments. Also, the resin layer 420 may define at least portion of the ice making space 410. Thus, an ice within the ice tray 400 contacting the resin layer 420 may be smoothly conveyed.

The resin layer 420 is disposed inside the ice tray 400. The resin layer 420 extends inward from the ice tray 400 at a position corresponding to each of the protrusions 432 to form a portion of the partition plate 430.

In detail, the partition plate 430 partitioning the inside of the ice tray 400 to define the plurality of ice making spaces 410 may be formed by the protrusion 432 and a resin layer extension part 434. Here, a portion of the ice tray 400 may extend to form the protrusion 432, and the resin layer extension part 434 may further extend from a position corresponding to that of the protrusion 432.

Various embodiments except the foregoing embodiments may be applied. Hereinafter, another embodiment will be described.

Another embodiment is different from the foregoing embodiments in that a resin layer and an ice tray are manufactured through separate processes and the resin layer is disposed on an inner surface of the ice tray. Thus, the parts except the ice tray and the resin layer are equal to those of the foregoing embodiments. Thus, the same part will be designated by the same reference numeral. Also, their detailed descriptions will be omitted.

FIG. 13 is a sectional view of an ice tray according to another embodiment.

Referring to FIG. 13, an ice tray 500 is formed of a metal material. Also, the ice tray 500 defines an ice making space 510 in which water is received to make ices. The ice making space 510 defined in the ice tray 500 may be defined as one space.

A resin layer 520 formed of a plastic resin material is disposed inside the ice tray 500. The resin layer 520 may be formed through various processes such as the above-described processes of the foregoing embodiments. Also, the resin layer 520 may define at least portion of the ice making space 510. Thus, an ice within the ice tray 500 contacting the resin layer 520 may be smoothly conveyed.

A partition plate 530 for partitioning the ice making space 510 into a plurality of spaces is disposed inside the ice tray 500. The partition plate 530 and the ice tray 500 may be manufactured through separate processes.

For example, the partition plate 530 may be formed of a separate material and disposed on the ice tray 500. Alternatively, the partition plate 530 may be integrated with an ejector 120 to partition the inside of the ice tray 500. The partition plate 530 may be fixed to a side of an ice maker except the ice tray 500.

The partition plate 530 may be formed of the same material as that of the resin layer 520 to more smoothly separate ices when the ices are conveyed.

FIG. 14 is a sectional view of an ice tray according to another embodiment.

Referring to FIG. 14, the ice tray 600 is formed of a metal material. Also, the ice tray 600 defines an ice making space 610 in which water is received to make ices. The ice making space 610 defined in the ice tray 600 may be defined as one space.

A plurality of protrusions 620 are disposed on an inner surface within the ice making space 610. Each of the protrusions 620 protrude at a position corresponding to that of the partition plate 630 partitioning the inside of the ice tray 600. Also, at least portion of each of the protrusions 620 may be spaced from the partition plate 630.

An outside of the protrusion 620 is covered by a resin layer 640 disposed inside the ice tray 600. The resin layer 640 may be formed through various processes such as the above-described processes of the foregoing embodiments. Also, the resin layer 640 may define at least portion of the ice making space 610. Thus, an ice within the ice tray 600 contacting the resin layer 640 may be smoothly conveyed.

A partition plate 630 for partitioning the ice making space 610 into a plurality of spaces is disposed inside the ice tray 600 corresponding to the protrusion 620. The partition plate 630 and the ice tray 600 may be manufactured through separate processes.

For example, the partition plate 630 may be formed of a separate material and disposed on the ice tray 600. Alternatively, the partition plate 630 may be integrated with an ejector 120 to partition the inside of the ice tray 600. The partition plate 630 may be fixed to a side of an ice maker except the ice tray 600.

The partition plate 630 may be formed of the same material as that of the resin layer 640 to more smoothly separate ices when the ices are conveyed.

Various embodiments except the foregoing embodiments may be applied. Hereinafter, another embodiment will be described.

Another embodiment is different from the foregoing embodiments in that an ice tray is rotatably disposed and a resin layer is disposed inside the ice tray.

Thus, the parts except an ice maker are equal to those of the foregoing embodiments. Thus, the same part will be designated by the same reference numeral. Also, their detailed descriptions will be omitted.

FIG. 15 is a perspective view of an ice maker according to another embodiment. FIG. 16 is a sectional view of the ice maker, i.e., a sectional view taken along line 16-16' of FIG. 15. FIG. 17 is a longitudinal sectional view of the ice maker and illustrates a sectional view, i.e., a sectional view taken along line 17-17' of FIG. 15. FIG. 18 is a schematic view of a control unit according to another embodiment.

As shown in FIGS. 15 to 18, an ice maker 700 includes a water supply part 710 connected to a water supply source to supply water, an ice tray 720 having an ice making space 722 in which the water supplied from the water supply part 710 is received to perform an ice making process, a partition plate 730 disposed at an opened side of the ice tray 720 to partition the ice making space 722 of the ice tray 720 into a plurality of unit spaces, and a driving unit 740 disposed at a side of the ice tray 720 to rotate the ice tray 720, thereby conveying ices.

The water supply part 710 includes a water supply tube 711 connecting the water supply source to the ice making space 722 of the ice tray 720, a water supply valve 712 disposed on a middle portion of the water supply tube 711 to adjust a water supply amount, and a water supply pump 713 disposed on an upstream or downstream side of the water supply valve 712 to pump the water. Here, although the water supply pump 713 is required for supplying a uniform water pressure, it is unnecessary to provide the water supply pump 713. When the water supply pump 713 is not provided, a height difference between the water supply source and the ice tray 720 may be used for supplying water.

The water supply tube 711 may be directly connected to the water supply source to supply water. Alternatively, the water supply tube 711 may be connected to a water tank (not shown) disposed in a refrigerating compartment 12 and receives a predetermined amount of water. In this case, the water tank may serve as the water supply source. Here, to supply an adequate amount of water into the ice tray 720, a water level sensor may be disposed in the ice tray 720 or a flow sensor for detecting a flow rate of water may be disposed in the water supply tube 711. Alternatively, a water level sensor may be disposed in the water tank.

The water supply valve 712 and the water supply pump 713 may be electrically connected to the separate control unit 760 to transmit/receive a signal therebetween. The control unit 760 may adjust a water supply amount based on values detected by the water level sensor or the flow sensor. Also, the control unit 760 may convert operation times of the water supply valve 712 and the water supply pump 713 into data to periodically turn the water supply valve 712 and the water supply pump 713 on/off.

The ice tray 720 includes a container part 721 providing an ice making space 7222 which receives water to make ices and a shaft part 725 protruding from one surface of the container part 721.

The container part 721 has an approximately semi-cylindrical shape in section to define one ice making space 722. As necessary, a slit (not shown) may be defined in a circumference direction of the container part 721 to insert a partition plate part 732 of the partition plate 730 into an inner surface of the container part 721. A pusher 723 protruding in a tooth shape to push ices into each of unit spaces is disposed on an opening end of a side of the container part 721. The shaft part 725 may be disposed at an approximately central portion of a shaft direction of the container part 721 and coupled to the driving unit 740 with a decelerator therebetween.

A resin layer 770 is disposed inside the ice tray 720. The resin layer 770 may be formed of a plastic resin material, unlike the ice tray 720 formed of a metal material. In detail, the resin layer 770 may be formed of various materials such as a water-repellent fluorocarbon resin, silicon, or polypropylene (PP).

The resin layer 770 defines at least portion of the ice making space 722 defined in the ice tray 720 to contact an ice made in the ice making space 722. Thus, when the ice is conveyed, the made ice may be easily separated from the ice tray 720.

The resin layer 770 may be formed through various processes such as the above-described processes of the foregoing embodiments. Also, the resin layer 770 may be disposed inside the ice tray 720, the whole partition plate 730, or a portion of the partition plate 730.

The partition plate 730 includes a fixed part 731 extending in the same direction as that of the shaft part 725 of the ice tray 720, having a shaft shape, and fixed to the driving unit 740, a plurality of partition plates 732 disposed with a predetermined distance along the shaft direction toward the ice tray 720 to partition the ice making space 722 into a plurality of unit spaces, and a stopper part 733 connecting top surfaces of the partition plates 732 to each other to convey ices within the unit spaces without being rotated together with the ice tray 720 when the ice tray 720 is rotated.

As described above, the fixed part 731 has one end integrally coupled and fixed to a motor housing 741 constituting the driving unit 740 and the other end rotatably coupled to a center of the container part 721 of the ice tray 720.

The partition plate part 732 has the same shape as that of the ice making space 722 when projected in the shaft direction, i.e., has a semi-cylindrical shape. An outer surface of the partition plate part 732 may contact an inner surface within the ice making space 722 to reduce a contact area between ices, thereby easily conveying the ices.

A water channel 735 having a predetermined depth is disposed at a side of the outer surface of the partition plate part 732, i.e., the lowest portion of the partition plate part 732 to move water into the unit spaces. The water channel 735 may pass through a center of the partition plate part 732.

As shown in FIG. 16, the stopper part 733 may be disposed on a side at which the pusher 723 of the ice tray 720 is disposed, i.e., at a front end when the ice tray 720 is rotated. The stopper part 733 may cover the entire top surface of the sides of the partition plate parts 732. As necessary, the stopper part 733 may protrude by a degree enough that the ices are not rotated together with the ice tray 720. However, since the stopper part 733 prevents water contained in the ice tray 720 from being splashed, the stopper part 733 may have wide area if possible.

A resin layer formed of the same material as that of the above-described resin layer may be further disposed on a surface of the partition plate 730, like the inner surface of the ice tray 720.

The driving unit 740 includes a motor housing 741 fixed to the ice making chamber 30, a driving motor 742 disposed inside the motor housing 741 to generate a rotation force, and a deceleration gear 743 coupled to the driving motor 742 to decelerate the rotation force, thereby transmitting the decelerated rotation force into the ice tray 720.

The shaft part 725 of the ice tray 720 is rotatably coupled to the motor housing 741. However, the fixed part 731 of the partition plate 730 is fixedly coupled to the motor housing 741.

Since ices within the ice tray 720 are separated from the ice maker 700 by the resin layer 770, a separate heater may be unnecessary. However, a heater 750 may be further disposed on the ice tray 720 as necessary.

The ice tray 720 may be formed of a thermally conductive material such as aluminum to separate ices from the ice making space 722 of the ice tray 720, and the heater 750 may be disposed on an outer surface of the ice tray 720. The heater 750 may include a heating wire heater contacting the outer surface of the ice tray 720.

The heater 750 may be controlled to cooperate with the water supply part 710. For example, it is determined whether a process in which water is supplied into the ice tray 720 to make ices is performed, whether an ice making process is performed, or whether an ice conveying process is performed after the ice making process is completed, based on a variation of the value detected by the water level sensor or the flow sensor of the water supply part 710. If it is determined that the process in which the water is supplied into the ice tray 720 to make the ices is performed or the ice making process is performed after the water supply is completed, an operation of the heater 750 may be stopped. However, if it is determined that the ice conveying process is performed after the ice making process is completed, the operation of the heater 750 may start.

Here, a time point at which the heater 750 is operated may be determined by detecting a temperature of the ice tray 720 in real-time or periodically. A time elapsed after the value detected by the water level sensor or the flow sensor of the water supply part 710 is changed may be converted into data. Then, the heater 750 may be forcibly operated according to the data. That is, whether the ice making process is completed may be confirmed by detecting the temperature of the ice tray 720 or through the ice making time. For example, when a temperature detected by a temperature sensor (not shown) disposed on the ice tray 720 is below a predetermined temperature, e.g., below a temperature of about −9° C. to about −12° C., it may be determined that the ice making process is completed. Also, when a predetermined time is elapsed after the water is supplied, it may be determined that the ice making process is completed. Thus, whether the ice making process is completed may be determined.

Although not shown, the heater 750 may be realized as a conductive polymer, a plate heater with positive thermal coefficient, an Al thin film, or other heat-transfer materials except the heating wire heater.

The heater 750 may be attached to a front surface of the ice tray 720. Also, although not shown, the heater 750 may be filled into the ice tray 720 or disposed on the inner surface of the inner surface of the ice tray 720. Furthermore, the ice tray 720 may be realized as a resistor that can generate heat without using a separate heater so that the ice tray 720 serves as a heater to generate heat when electricity is applied to at least portion of the ice tray 720.

Also, the heater 750 may be spaced a predetermined distance from the ice tray 720 without contacting the ice tray 720 to serve as a heat source. For another example, a light source emitting light onto at least one of the ice and the ice tray 720 or a magnetron emitting a microwave onto at least one of the ice and the ice tray 720 may be used as the heat source. As described above, the heat source such as the heater, the light source, or the magnetron may directly apply heat energy on at least one of the ice and the ice tray 720 or a boundary between the ice and the ice tray 720 to melt a portion of the boundary between the ice and the ice tray 720. Thus, when the ice tray 720 is rotated, the ice may be separated from the ice tray 720 by a self-weight or the pusher 723 of the ice tray 720 in a state where the boundary between the ice and the ice tray 720 does not completely thaw.

The heater 750 and the driving motor 742 may be controlled together with each other by one control unit 760 electrically connected to the heater 750 and the driving motor 742, i.e., a Micom (micro processor unit). For example, as shown in FIG. 18, the control unit 760 may include a detection part 761 connected to a temperature sensor (not shown) for detecting a temperature of the ice tray 720 or a timer (not shown) for detecting a time elapsed after the water is supplied, a determination part 762 for determining whether the ice making process is completed by comparing the temperature and time detected by the detection part 761 to a reference value, and a command part 763 for controlling an on/off operation of the heater 750 and an operation of the driving motor 742 according to the determination of the determination part 762.

An ice supply method in the refrigerator will be described with reference to FIG. 19.

FIG. 19 is a longitudinal sectional view illustrating an ice making process of the ice maker.

Referring to FIG. 19, when the ice making process is required, the ice maker 700 is turned on, and thus, the ice making process starts. When the ice making process starts, the water supply part 710 supplies water into the ice tray 720. Here, a water supply amount may be detected in real-time using the water level sensor disposed in the ice tray 720, the flow sensor disposed in the water supply tube 711, or the water level sensor disposed in the water tank. The detected water supply amount may be transmitted into the Micom. The Micom may compare the transmitted water supply amount to a set water supply amount. Thus, it is determined whether an adequate amount of water is supplied into the ice tray 720. When it is determined that the adequate amount of water is supplied, the water supply valve 712 of the water supply part 710 may be blocked to prevent the water from flowing into the ice tray 720.

When the water is completely supplied into the ice tray 720, the water within the ice tray 720 is exposed to cool air supplied into the ice making chamber 30 for a predetermined time and thus is frozen. When the water within the ice tray 720 is converted into an ice, the temperature sensor (not shown) may periodically detect a temperature of the ice tray 720 or detect the temperature of the ice tray 720 in real-time to transmit the detected value into the Micom. The Micom compares the received temperature to a set temperature. Thereafter, when it is determined whether a surface of the water contained in the ice tray 720 is frozen, a series of operations may be stopped and converted into the ice conveying process.

The resin layer 770 of the ice tray 720 contacts the ice in a state where the water contained in the ice tray 720 is converted into an ice. The resin layer 770 may have a smooth surface and water repellency due to characteristics of material. Thus, the ice contacting the resin layer 770 may be easily separated from the ice tray 720.

When the driving motor 742 is operated by the control unit 760 to rotate the container part 721 of the ice tray 720 with respect to the shaft part 725, the ices within the unit spaces are blocked by the stopper part 733 of the partition plate 730. The ices are not rotated along the ice tray 720. Thus, the ice tray 720 is further rotated to allow the pusher 723 of the ice tray 720 to pass between the partition plate parts 732 disposed at a side opposite to that of the stopper part 733 of the partition plate 730. As a result, the ices within the unit spaces may be pushed by the rotation force of the driving motor 742. Thereafter, the ices attached to the partition plate 730 are separated from the partition plate parts 732 of the partition plate 730 and freely fall down. Then, the ices may be discharged into the ice bank 40 or directly discharged toward the dispenser 26.

When the heater 750 is disposed on the ice maker 700, the heater 750 is operated to heat the ice tray 720 when the ices are conveyed. When the ice tray 720 is heated, the ices contacting the ice tray 720 may be melted and thus easily separated from the ice tray 720.

Various embodiments except the foregoing embodiments may be applied. Hereinafter, another embodiment will be described.

Another embodiment is different from the foregoing embodiments in that an ice tray is rotated by a driving unit, a resin layer is disposed within the ice tray, and a stopper for conveying an ice when an ice making container is rotated is provided.

Thus, the parts except an ice maker are equal to those of the foregoing embodiments. Thus, the same part will be designated by the same reference numeral. Also, their detailed descriptions will be omitted.

FIG. 20 is a perspective view illustrating an ice maker of FIG. 1 according to another embodiment. FIG. 21 is a sectional view taken along line 21-21' of FIG. 20. FIG. 22 is a perspective view of a back surface of the ice maker. FIG. 23 is a schematic view of a control unit according to another embodiment.

As shown in FIGS. 20 to 23, an ice maker 800 includes a water supply part 810 connected to a water supply source to supply water, an ice tray 820 having an ice making space 822 in which the water supplied from the water supply part 810 is received to perform an ice making process, a partition plate 830 for partitioning the ice making space 822 of the ice tray 820 into a plurality of unit spaces, a stopper 840 disposed at an opened side of the ice tray 820 to convey the ices within the ice tray, and a driving unit 840 disposed at a side of the ice tray 820 to rotate the ice tray 820, thereby conveying the ices.

The water supply part 810 includes a water supply tube 811 connecting the water supply source to the ice making space 822 of the ice tray 820, a water supply valve 812 disposed on a middle portion of the water supply tube 811 to adjust a water supply amount, and a water supply pump 813 disposed on an upstream or downstream side of the water supply valve 812 to pump the water. Here, although the water supply pump 813 is required for supplying a uniform water pressure, it is unnecessary to provide the water supply pump 813. When the water supply pump 813 is not provided, a height difference between the water supply source and the ice tray 820 may be used for supplying water.

The water supply tube 811 may be directly connected to the water supply source to supply water. Alternatively, the water supply tube 811 may be connected to a water tank (not shown) disposed in a refrigerating compartment 12 and receives a predetermined amount of water. In this case, the water tank may serve as the water supply source. Here, to supply an adequate amount of water into the ice tray 820, a water level sensor may be disposed in the ice tray 820 or a flow sensor for detecting a flow rate of water may be disposed in the water supply tube 811. Alternatively, a water level sensor may be disposed in the water tank.

The water supply valve 812 and the water supply pump 813 may be electrically connected to the separate control unit 860 to transmit/receive a signal therebetween. The control unit 860 may adjust a water supply amount based on values detected by the water level sensor or the flow sensor. Also, the control unit 860 may convert operation times of the water supply valve 812 and the water supply pump 813 into data to periodically turn the water supply valve 812 and the water supply pump 813 on/off.

The ice tray 820 has an approximately semi-cylindrical shape in section to define one ice making space 822. A resin layer 821 is disposed inside the ice tray 820. The resin layer 821 may be formed of a plastic resin material, unlike the ice tray 820 formed of a metal material. In detail, the resin layer 821 may be formed of various materials such as a water-repellent fluorocarbon resin, silicon, or polypropylene (PP).

The resin layer 821 defines at least portion of the ice making space 822 defined in the ice tray 820 to contact an ice made in the ice making space 822. Thus, when the ice is conveyed, the made ice may be easily separated from the ice tray 820.

The resin layer 821 may be formed through various processes such as the above-described processes of the foregoing embodiments. Also, the resin layer 821 may be disposed inside the ice tray 820, the whole partition plate 830, or a portion of the partition plate 830.

The partition plate 830 may be provided in plurality so that the plurality of partition plates 830 are disposed with a predetermined distance along a length direction of the ice tray 820 to partition the ice making space 822 into a plurality of unit spaces.

Each of the partition plates 830 has the same shape as that of the ice making space 822 when projected in the shaft direction, i.e., has a semi-cylindrical shape. An outer surface of the partition plate 830 may contact an inner surface within the ice making space 822 to reduce a contact area between ices, thereby easily conveying the ices.

A water channel 181 having a predetermined depth is disposed at a side of the outer surface of the partition plate 830, i.e., the lowest portion of the partition plate 830 to move water into the unit spaces. At least portion of the partition plate 830 may be spaced from an inner surface of the ice maker 800 by the formation of the water channel 181.

The stopper 840 may connect top surfaces of the partition plates 830 to each other and be integrated with the partition plates 830 so that ices within the unit spaces are conveyed without being rotated together with the ice tray 820 when the ice tray 820 is rotated. The resin layer 821 may be disposed on a surface of the stopper 840 and surfaces of the partition plates 830 except the ice making space 822 within the ice tray 820.

As shown in FIG. 21, the stopper 840 may be disposed at a side contacting the ice contacts first when the ice tray 820 is rotated. The stopper 840 may be disposed to cover the entire top surface of a side of the partition plates 830. As necessary, the stopper 840 may have an uneven shape enough to prevent the ice from being rotated together with the ice tray 820. However, the stopper 840 may prevent water contained in the ice tray 820 from being splashed as well as have a wide space between a top surface thereof and the inner surface of the ice tray 820 so that a water storage space 841 is defined in the wide space and a plate shape so that an end thereof contacts the inner surface of the ice tray 820.

Also, the stopper 840 may be inclined downward toward the inner surface of the ice tray 820 so that the water storage space 841 is defined in the top surface thereof. A blocking part 842 for preventing water within the water storage space 841 from being introduced into the ice making space 822 may be disposed on an end of the inner surface of the stopper 840. Here, the blocking part 842 may have a predetermined height.

The driving unit 850 includes a motor housing 851 fixed to the ice making chamber 30, a driving motor 852 disposed inside the motor housing 851 to generate a rotation force, and a deceleration gear 843 coupled to the driving motor 852 to decelerate the rotation force, thereby transmitting the decelerated rotation force into the ice tray 820.

Since ices within the ice tray 820 are separated from the ice maker 800 by the resin layer 821, a separate heater may be unnecessary. However, a heater 870 may be further disposed on the ice tray 820 as necessary.

A frame 860 fixedly coupled to the refrigerator door 20 may be disposed on a side of the top surface of the partition plate 830, i.e., a side opposite to that of the stopper 840. A heater insertion groove 861 may be defined in the frame 860 to locate the heater 870 used for conveying ices therein.

The frame 860 may be formed of a material such as aluminum having superior heat conductivity and integrated with the partition plate. In this case, the partition plate 830 may be formed of an aluminum material having superior heat conductivity, like the frame 860.

The heat insertion groove 861 may be longitudinally disposed along a length direction of the ice tray 820.

The heater 870 may be controlled to cooperate with the water supply part 810. For example, it is determined whether a process in which water is supplied into the ice tray 820 to make ices is performed, whether an ice making process is performed, or whether an ice conveying process is performed after the ice making process is completed, based on a variation of the value detected by the water level sensor or the flow sensor of the water supply part 810. If it is determined that the process in which the water is supplied into the ice tray 820 to make the ices is performed or the ice making process is performed after the water supply is completed, an operation of the heater 870 may be stopped. However, if it is determined that the ice conveying process is performed after the ice making process is completed, the operation of the heater 870 may start.

Here, a time point at which the heater 870 is operated may be determined by detecting a temperature of the ice tray 820 or the frame 860 in real-time or periodically. A time elapsed after the value detected by the water level sensor or the flow sensor of the water supply part 810 is changed may be converted into data. Then, the heater 870 may be forcibly operated according to the data. That is, whether the ice making process is completed may be confirmed by detecting the temperature of the ice tray 820 or the frame 860 or through the ice making time. For example, when a temperature detected by a temperature sensor (not shown) disposed on the ice tray 820 or the frame 860 is below a predetermined temperature, e.g., below a temperature of about −9° C., it may be determined that the ice making process is completed. Also, when a predetermined time is elapsed after the water is supplied, it may be determined that the ice making process is completed. Thus, whether the ice making process is completed may be determined.

The heater 870 may have a long rod shape and be inserted into the heater insertion groove 861 of the frame 860. However, as necessary, the heater 870 may be realized as a conductive polymer, a plate heater with positive thermal coefficient, an Al thin film, or other heat-transfer materials except the heating wire heater.

Also, the heater 870 may be spaced a predetermined distance from the frame 860 without contacting the frame 860 to serve as a heat source. For another example, a light source emitting light onto at least one of the ice and a manner contacting the ice or a magnetron emitting a microwave onto at least one of the ice and the manner contacting the ice may be used as the heat source. As described above, the heat source such as the heater, the light source, or the magnetron may directly apply heat energy on at least one of the ice and the manner contacting the ice or a boundary between the ice and the manner to melt a portion of the boundary between the ice and the manner. Thus, when the ice tray 820 is rotated, the ice may be separated from the ice tray 820 by a self-weight or the stopper 840 in a state where the boundary between the ice and the manner does not completely thaw.

The heater 870 and the driving motor 852 may be controlled together with each other by one control unit 880 electrically connected to the heater 870 and the driving motor 852, i.e., a Micom (micro processor unit). For example, as shown in FIG. 6, the control unit 880 may include a detection part 881 connected to a temperature sensor (not shown) for detecting a temperature of the ice tray 820 or the frame 860 or a timer (not shown) for detecting a time elapsed after the water is supplied, a determination part 882 for determining whether the ice making process is completed by comparing the temperature and time detected by the detection part 881 to a reference value, and a command part 883 for controlling an on/off operation of the heater 870 and an operation of the driving motor 852 according to the determination of the determination part 882.

When the ice maker 800 is disposed in the refrigerator door 20, the water filled in the ice tray 820 may be poured before the water is completely frozen when the refrigerator door 20 is opened or closed. Thus, a cover 890 for prevent the water contained in the ice tray 820 from overflowing may be further disposed on an upper portion of the frame 860.

The cover 890 has a semicircular shape protruding in a direction opposite to that of the ice tray 820 in section. A water supply hole 891 may be widely defined in a horizontal direction at a center of an upper end of the cover 890. An elastic part 892 may be disposed on the cover so that the cover 890 is elastically widened when the ice tray 820 is rotated.

An ice supply method in the refrigerator will be described with reference to FIG. 24.

FIG. 24 is a longitudinal sectional view illustrating an ice making process of the ice maker.

Referring to FIG. 24, when the ice making process is required, the ice maker 800 is turned on, and thus, the ice making process starts. When the ice making process starts, the water supply part 810 supplies water into the ice tray 820. Here, a water supply amount may be detected in real-time using the water level sensor disposed in the ice tray 820, the flow sensor disposed in the water supply tube 811, or the water level sensor disposed in the water tank. The detected water supply amount may be transmitted into the Micom. The Micom may compare the transmitted water supply amount to a set water supply amount. Thus, it is determined whether an adequate amount of water is supplied into the ice tray 820. When it is determined that the adequate amount of water is supplied, the water supply valve 812 of the water supply part 810 may be blocked to prevent the water from flowing into the ice tray 820.

When the water is completely supplied into the ice tray 820, the water within the ice tray 820 is exposed to cool air supplied into the ice making chamber 30 for a predetermined time and thus is frozen. When the water within the ice tray 820 is converted into an ice, the temperature sensor (not shown) may periodically detect a temperature of the ice tray 820 or detect the temperature of the ice tray 820 in real-time to transmit the detected value into the Micom. The Micom compares the received temperature to a set temperature. Thereafter, when it is determined whether a surface of the water contained in the ice tray 820 is frozen, a series of operations may be stopped and converted into the ice conveying process.

The resin layer 821 of the ice tray 820 contacts the ice in a state where the water contained in the ice tray 820 is converted into an ice. The resin layer 821 may have a smooth surface and water repellency due to characteristics of material. Thus, the ice contacting the resin layer 821 may be easily separated from the ice tray 820.

The driving motor 852 is operated by the control unit 880 to rotate the ice tray 820. Here, the ices which are not completely separated from the ice tray 820 within the unit spaces may be rotated along the ice tray 820.

However, the stopper 840 may prevent the ices within the unit spaces from being rotated along the ice tray 820. Thus, when the ice tray 820 is rotated, the ices attached to the ice tray 820 are separated from the ice tray 820 and freely fall down. Then, the ices may be discharged into the ice bank 40 or directly discharged toward the dispenser 26.

Here, remaining water may occur due to the melt of an interface of the ice. The remaining water may be moved in a state where it is stored in the ice tray 820. Then, the remaining water is introduced into the water storage space 841 defined between the stopper 840 and the inner surface of the ice tray 820 to prevent the water from being introduced into the ice bank 40. Thus, it is prevented that the ices stored in the ice bank 40 get tangled with each other to reduce quality of ice.

When the heater 870 is disposed in the ice maker 800, the heater 870 may be operated to easily separate the ices made in the ice tray 820 when the ices are conveyed.

INDUSTRIAL APPLICABILITY

According to the embodiments, a portion of the ice tray may be formed of a metal material having superior heat conductivity to increase an amount of ices. In addition, the ices may be easily conveyed by the water-repellent resin layer to reduce power consumption required for conveying the ices. Therefore, industrial applicability is very high.

The invention claimed is:

1. A refrigerator, comprising:

a cabinet defining a storage space; and an ice maker disposed in the storage space, the ice maker being configured to make ice, wherein ice maker comprises:

an ice tray configured to receive water for making the ice, the ice tray being formed of a metal material and including:

a container part defining a single water storing space in a substantially semi-cylindrical shape, a shaft part protruding from a side surface of the container part;

a plurality of pushers integrally protruding from a rear upper end of the container part towards a center of the container part;

a driving unit coupled to the shaft part of the ice tray and configured to rotate the ice tray to thereby separate the ice from the ice tray, the driving unit including:

a motor housing;

a driving motor disposed inside the motor housing and configured to generate a rotation force; and a deceleration gear coupled to the driving motor and the shaft part and configured to transfer decelerated rotation force to the shaft part;

a partition plate received in the single water storing space of the container part, wherein the container part is rotatably assembled to the partition plate to separate the ice from the container part, the partition plate including:

a fixed part that has a bar shape and that extends in a same direction as that of the shaft part of the ice tray, wherein the ice tray rotates with respect to the fixed part by the driving unit, a plurality of partition plate parts extending from an outer surface of the fixed part with a predetermined distance in a longitudinal direction of the fixed part to partition the single water storing space of the container part into a plurality of ice making spaces, and a stopper part extending radially from the outer surface of the fixed part in a plate shape to cover an entire top surface of sides of the partition plate parts to stop the ice from being rotated together with the container part of the ice tray, wherein a lower end of each partition plate part is spaced apart from an inner surface of the container part of the ice tray to define a water channel therebetween, and the fixed part is arranged to pass through the shaft part and is fixed to the motor housing of the driving unit to allow the container part to rotate about the fixed part for ice separation, wherein the partition plate parts are maintained in a fixed state while the container part rotates to thereby first separate a bottom surface of ice pieces in the ice making spaces from the inner surface of the container, and wherein each of the plurality of pushers is disposed between the partition plate parts and configured to push an upper surface of the ice pieces to thereby separate side surfaces of the ice pieces from the partition plate parts after the bottom surface of the ice pieces has been separated by the rotation of the container part.

2. The refrigerator according to claim 1, further comprising a resin layer formed of a resin, the resin layer defining at least a portion of the inner surface of the container part of the ice tray to smoothly convey the ice.

3. The refrigerator according to claim 2, wherein the resin layer is coated on the molded ice tray.

4. The refrigerator according to claim 1, wherein the ice maker further comprises a heater for heating a surface of the container part of the ice tray.

5. The refrigerator according to claim 1, wherein the pusher protrudes in plurality in a tooth shape, and the plurality of the pushers are disposed on an opening end of a side of the container part of the ice tray with a predetermined distance away from each other.

6. The refrigerator according to claim 5, wherein the plurality of pushers respectively pass between adjacent partition plate parts to push the other end of the upper surface of the ice.

7. The refrigerator according to claim 6, wherein the stopper part is disposed on a side at which the pusher of the ice tray is disposed and the stopper part.

8. The refrigerator according to claim 1, wherein the stopper part connects top surfaces of the partition plate parts to each other to stop rotation of the ice together with the ice tray.

* * * * *